US005640919A

United States Patent [19]

Huisman

[11] Patent Number: 5,640,919

[45] Date of Patent: Jun. 24, 1997

[54] BOOM-STRUCTURE

[75] Inventor: Wolter Huisman, Vollenhove, Netherlands

[73] Assignee: Rondal B.V., Vollenhove, Netherlands

[21] Appl. No.: 549,748

[22] PCT Filed: Mar. 24, 1995

[86] PCT No.: PCT/NL95/00115

§ 371 Date: Feb. 23, 1996

§ 102(e) Date: Feb. 23, 1996

[87] PCT Pub. No.: WO95/26296

PCT Pub. Date: Oct. 5, 1995

[30] Foreign Application Priority Data

Mar. 25, 1994 [NL] Netherlands ..... 9400485

[51] Int. Cl.[6] ..... B03H 9/04

[52] U.S. Cl. ..... 114/106; 114/107

[58] Field of Search ..... 114/39.1, 39.2, 114/89, 90, 97, 102, 103, 104, 105, 106, 107, 108

[56] References Cited

U.S. PATENT DOCUMENTS 4,116,152 9/1978 Larsson ..... 114/104

4,679,520 7/1987 Harken ..... 114/104

5,181,477 1/1993 Harken et al. ..... 114/106

FOREIGN PATENT DOCUMENTS 0229675 7/1987 European Pat. Off. .

0290660 11/1988 European Pat. Off. .

*Primary Examiner*—Stephen Avila

*Attorney, Agent, or Firm*—Webb Ziesenheim Bruening Logsdon Orkin & Hanson, P.C.

[57] ABSTRACT

The invention relates to a boom for a sailing boat including: an elongate structure which bounds a cavity extending in longitudinal direction; a slotted hole extending on the top side thereof in longitudinal direction; and a pulling member drivable by a first drive means and extending in a longitudinal direction for pulling through the slotted hole into the cavity and storing therein a part of the sail to be rendered inoperative. The invention provides a boom of the type stated in the background which has the feature that the slotted hole is bounded by two mutually parallel prismatic edges with which a carriage movable therealong co-acts such that the carriage prevents a relative displacement of these edges away from each other, which carriage is movable at least partly by second drive means.

16 Claims, 5 Drawing Sheets

BOOM-STRUCTURE

BACKGROUND OF THE INVENTION

The invention relates to a boom for a sailing boat that includes:

an elongate structure which bounds a cavity extending in longitudinal direction;

a slotted hole extending on the top side thereof in longitudinal direction; and a pulling member drivable by first drive means and extending in the cavity in longitudinal direction for pulling through the slotted hole into the cavity and storing therein a part of the sail to be rendered inoperative.

When sailing takes place with a known boom, the sail exerts a force on the edges of the slotted hole such that these edges tend to move apart. The open boom-structure is hereby placed under relatively heavy strain of bending in its transverse plane.

It is an object of the invention to reduce this strain.

SUMMARY OF THE INVENTION

In this respect the invention provides a boom of the type stated in the background which has the feature that the slotted hole is bounded by two mutually parallel prismatic edges with which a carriage movable therealong co-acts such that the carriage prevents a relative displacement of these edges away from each other, which carriage is movable at least partly by second drive means.

In a particular embodiment the boom according to the invention has the feature that the carriage is slidable. The carriage can also be rollable. The carriage can engage round the said edges or the edges can engage round the carriage.

The carriage has a number of functions. A first function is to tension and hold tensioned the foot when the sail is reefed out. In addition the carriage can effectively hold together the said edges in diverse reefing positions, while in reefed and non-reefed situation the carriage can be used for stretching the foot. The swing tension in the reefed situation can be fixed at a predetermined value.

A particular embodiment has the special feature that the first drive means includes at least one element which extends in lengthwise direction, is rotatably drivable round its longitudinal axis and which is coupled to the sail for exerting on that sail during operation of the drive means a tensile force for displacing the sail through the slotted hole to the cavity.

It will be apparent that the drive means must be able to exert a sufficiently large tensile force on the sail to overcome the opposing force or forces exerted by this sail, particularly when there is some wind load.

A specific embodiment has the feature that the element is a winding shaft extending in longitudinal direction in the cavity.

The boom according to the invention preferably has the special feature that in any operating position of the sail the carriage assumes relative to the boom a position which in any reefed situation is located closer to the mast than in non-reefed situation.

The embodiment is recommended which has the special feature that the second drive means includes at least one cable which is connected to the carriage and on which a tensile force can be exerted by a motor. A tensile force directed away from the mast can be of particular importance for tensioning and holding tensioned the foot.

In preference the boom is provided with a carriage which can be fixed relative to the boom by blocking means.

The carriage can be provided for this purpose with manually operated blocking means, while in the above described embodiment the fixing can consist of the fact that the motor is of the self-braking type.

The boom can be manufactured of any suitable construction material or composition thereof, for instance aluminium. In the case where the boom has a prismatic shape, that is, a shape in which the cross section is identical everywhere along the whole length, the boom can be embodied as extrusion profile. The boom can also be embodied in a fibre-reinforced plastic, a sandwich structure or other structure of sufficient strength. Particularly fibres with tensile strength such as carbon fibres, glass fibres, aramide and the like are very suitable for reinforcing purposes.

Particularly in the case where the boom-structure consists substantially of plastic, the boom can advantageously have the feature that at least the edges of the slotted hole are manufactured by extrusion. This embodiment can display the special feature that the edges consist of aluminium.

In the case where the boom-structure consists for the major part of plastic, for instance a sandwich structure of an epoxy material with carbon fibres as skin plates, together with a polyurethane filling, the said edges of for instance extruded aluminium can be coupled thereto by bolts and a glue connection.

The carriage can in principle be manufactured of any suitable material. The preferred embodiment has the special feature that the carriage consists of metal, for example stainless steel, aluminium, titanium.

A specific embodiment of the boom according to the invention has the characteristic that the carriage and the sail can be coupled in the area of the leech thereof by means of coupling means. A specific embodiment hereof displays the special feature that the coupling means includes a hooking means. Such hooking means can also be used for coupling the front edge of the sail at the mast to the boom.

BRIEF DESCRIPTION OF THE DRAWINGS

The invention will now be elucidated with reference to the annexed drawings. Herein.

DESCRIPTION OF THE PREFERRED EMBODIMENT

Figure 1:
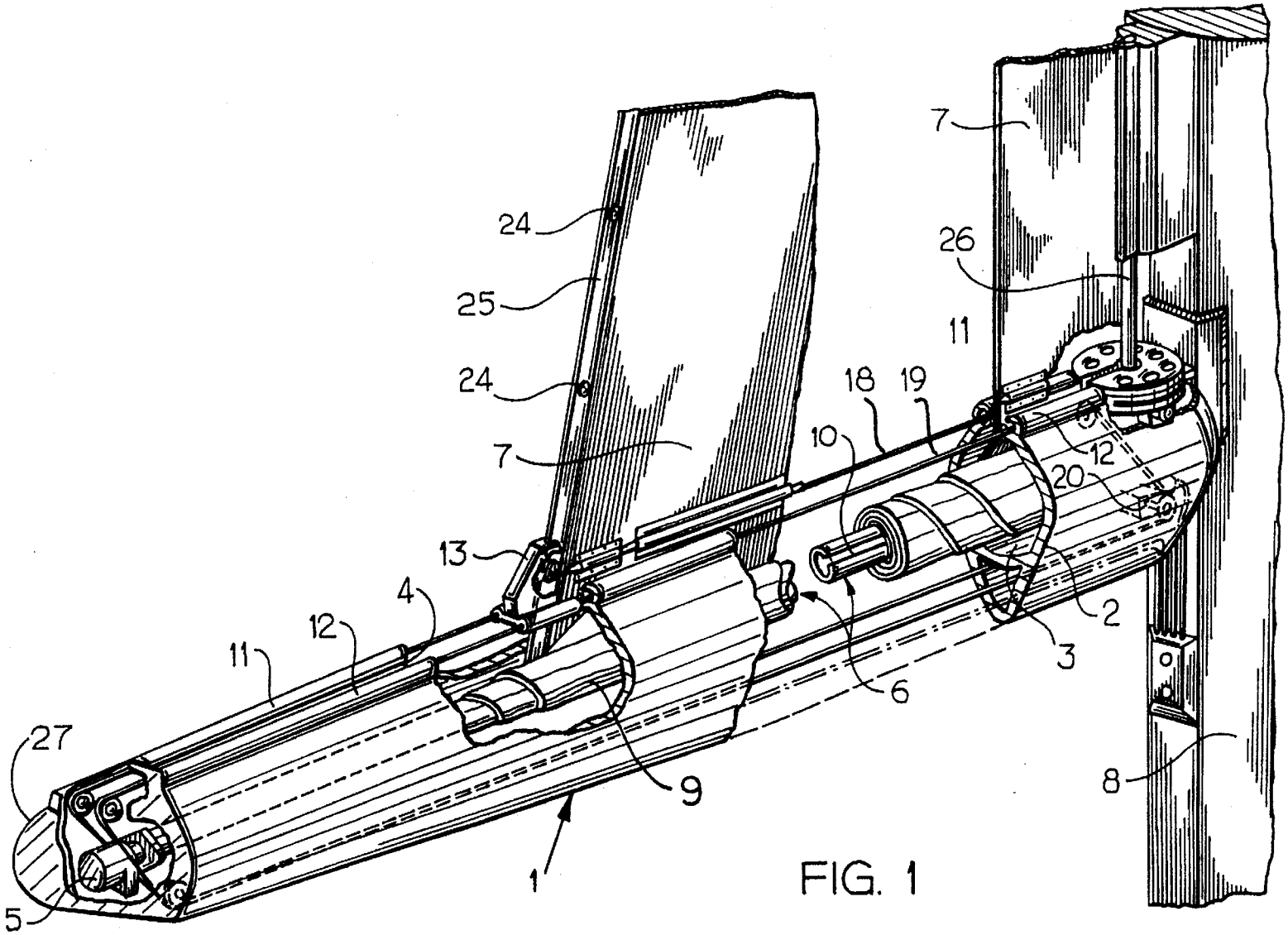
FIG. 1 shows a partly broken away perspective view of a first embodiment of the structure according to the invention.

FIG. 1 shows a boom 1 according to the invention in a first embodiment. Boom 1 comprises an elongate structure 2 of aluminium which bounds a cavity 3 extending in lengthwise direction, a slotted hole 4 extending on the top side of the structure 2 thereof in lengthwise direction and a winding shaft 6 drivable by a motor 5 and extending in lengthwise direction for winding up and unwinding a sail movable through the slotted hole 4. The motor 5 serves particularly to exert a downward directed tensile force on a sail 7 which is connected guidably in vertical direction to a mast 8. The winding shaft 6 serves particularly to pull through the slotted hole 4 into the cavity 3 and store therein a part 9 of the sail 7 for placing out of use. The winding shaft 6 is preferably embodied more or less with torsional stiffness. Sail 7 is inserted into shaft 6 via an undercut longitudinal channel 10 by means of a widened bottom edge into which for instance a cable is woven.

Figure 2:
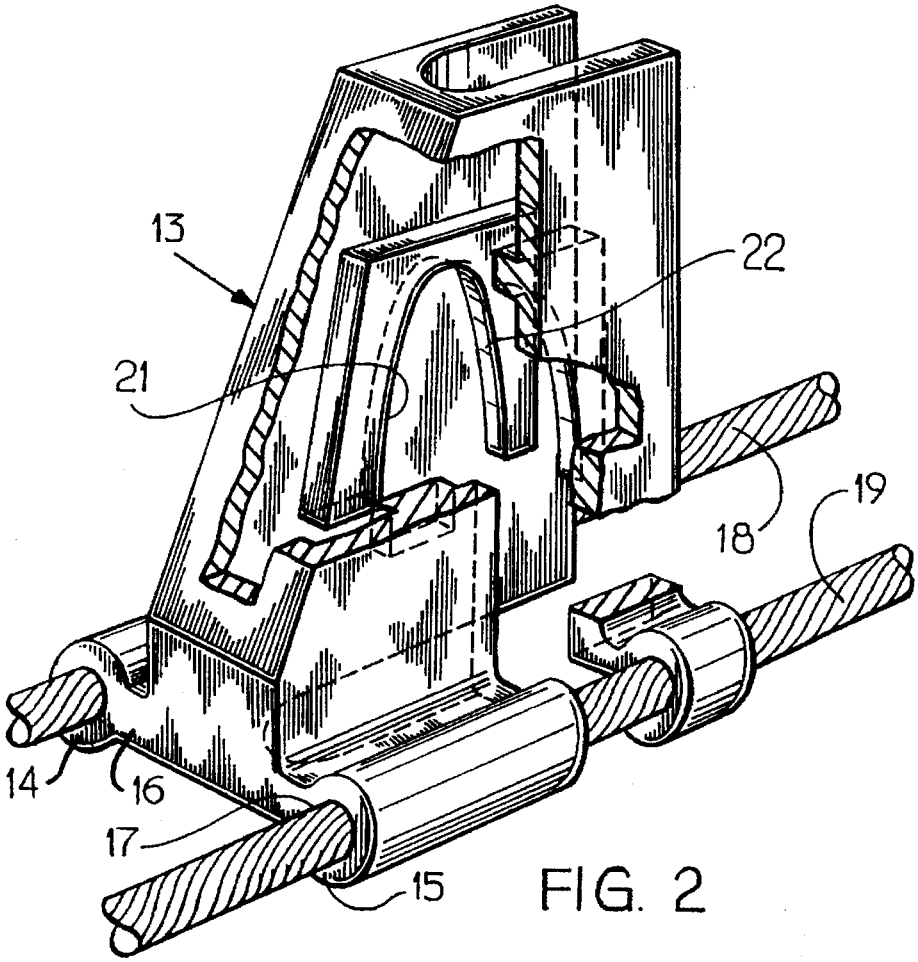
FIG. 2 shows a partly broken away perspective view on enlarged scale of the carriage with hooking means as according to FIG. 1.

The slotted hole 4 is bounded by two mutually parallel prismatic edges 11, 12 in which a carriage 13 is received slidably for movement therealong. The edges 11, 12 have a curved form with mutually facing openings, while carriage 13, as can be seen particularly in FIG. 2, has widened side parts 14, 15 having a partially cylindrical form which fit into the cavities in edges 11, 12, which parts 14, 15 are coupled to the rest of the carriage 13 via narrowed bridges 16, 17 respectively which are narrow enough to pass through the longitudinal openings in edges 11, 12, while the side parts 14, 15 are too wide to do so. The carriage 13 is thus slidably accommodated between the edges, while it blocks a relative displacement of these edges 11, 12 away from each other. In the embodiment shown in FIGS. 1 and 2, the carriage 13 is coupled via the side parts 14, 15 to mutually parallel cables 18, 19 which are displaceable by means of a schematically designated motor 20 with co-movement of the carriage 13. The co-action between motor 5 and 20 will be further discussed hereinbelow.

Figure 3:
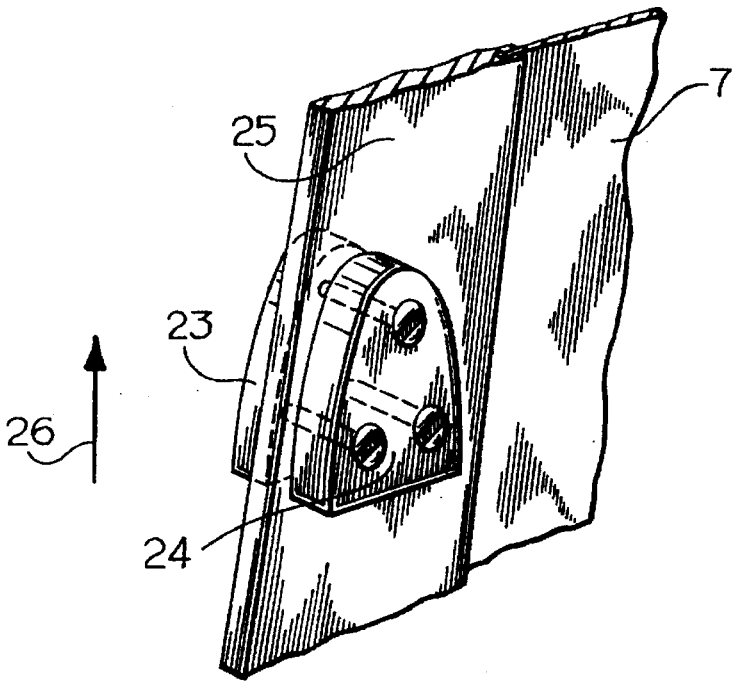
FIG. 3 shows the leech of the sail to which are fixed hooking protrusions for co-action with the carriage according to FIG. 2.

The carriage 13 comprises two hooks 21, 22 which extend on either side and which are open on the underside and are thus accessible by the correspondingly formed blocks 23, 24 shown in FIG. 3 which are connected to the upward inclining, strengthened free edge 25 of sail 7, and are arranged at a number of positions thereon as shown in FIG. 1, and which block the upward directed movement 26 of the sail 7 under load.

In order to wind up the sail 7 the motor 5, preferably a hydraulic motor, is energized. A downward directed force 7 is hereby exerted on the sail, whereby the connection between the blocks 23, 24 and the hooks 21, 22 is broken. After reaching a desired position the connection between following sets of blocks 23, 24 on the one hand and hooks 21, 22 on the other can be restored after a displacement of carriage 13 is performed via cables 18, 19 by energizing the hydraulic motor 20 such that the carriage is placed at the correct position.

For downward movement of the sail 7 under the influence of the motor 5 the upward directed forces on the sail have to be neutralized, at any rate limited. For this purpose a tensile force exerted on the reinforced leading edge or luff 26 of the sail can be neutralized by means of unshown means. For the reverse movement, wherein the sail part 9 is unwound from shaft 6, an upward directed force can, while the motor 5 applies a certain braking force, be exerted on the luff 26 after the coupling between blocks 23, 24 and hooks 21, 22 has been made inactive by energizing the motor. By energizing the motor 20 the carriage 13 is displaced in the direction of the free end 27 of the boom to a desired new coupling position between a set of blocks 23, 24 and the hooks 21, 22.

Figure 4:
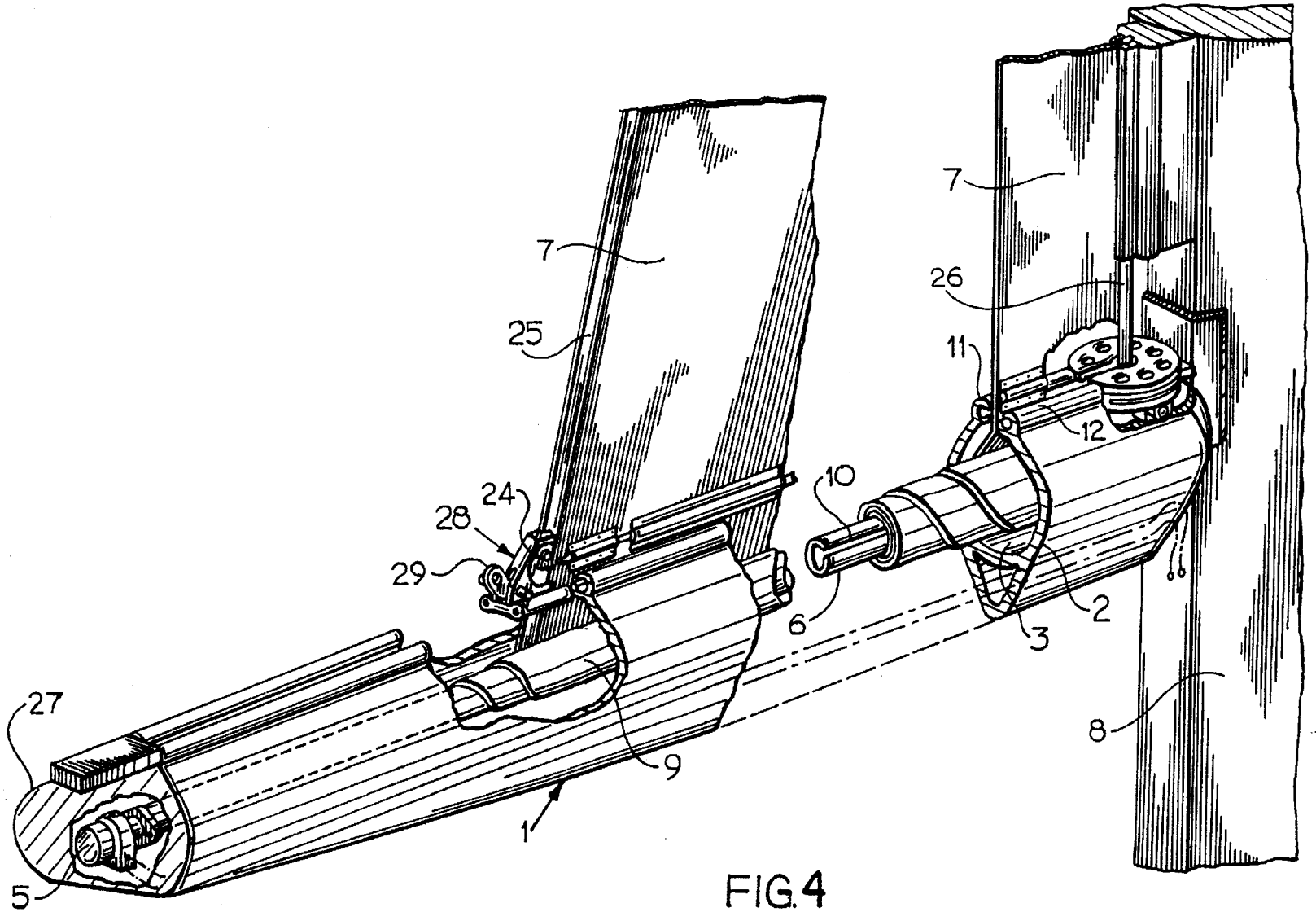
FIG. 4 shows a view corresponding with FIG. 1 of a variant.

FIG. 4 shows a variant in which the carriage 28 is manually slidable along the edges 11, 12. By means of a spring-loaded braking mechanism the carriage 28 retains a chosen position relative to the boom 1. By depressing a control lever 29 the rigid coupling between carriage 28 and boom 1 is released and carriage 28 can slide. The structure according to FIG. 4 is otherwise the same as that according to FIG. 1.

Figure 5:
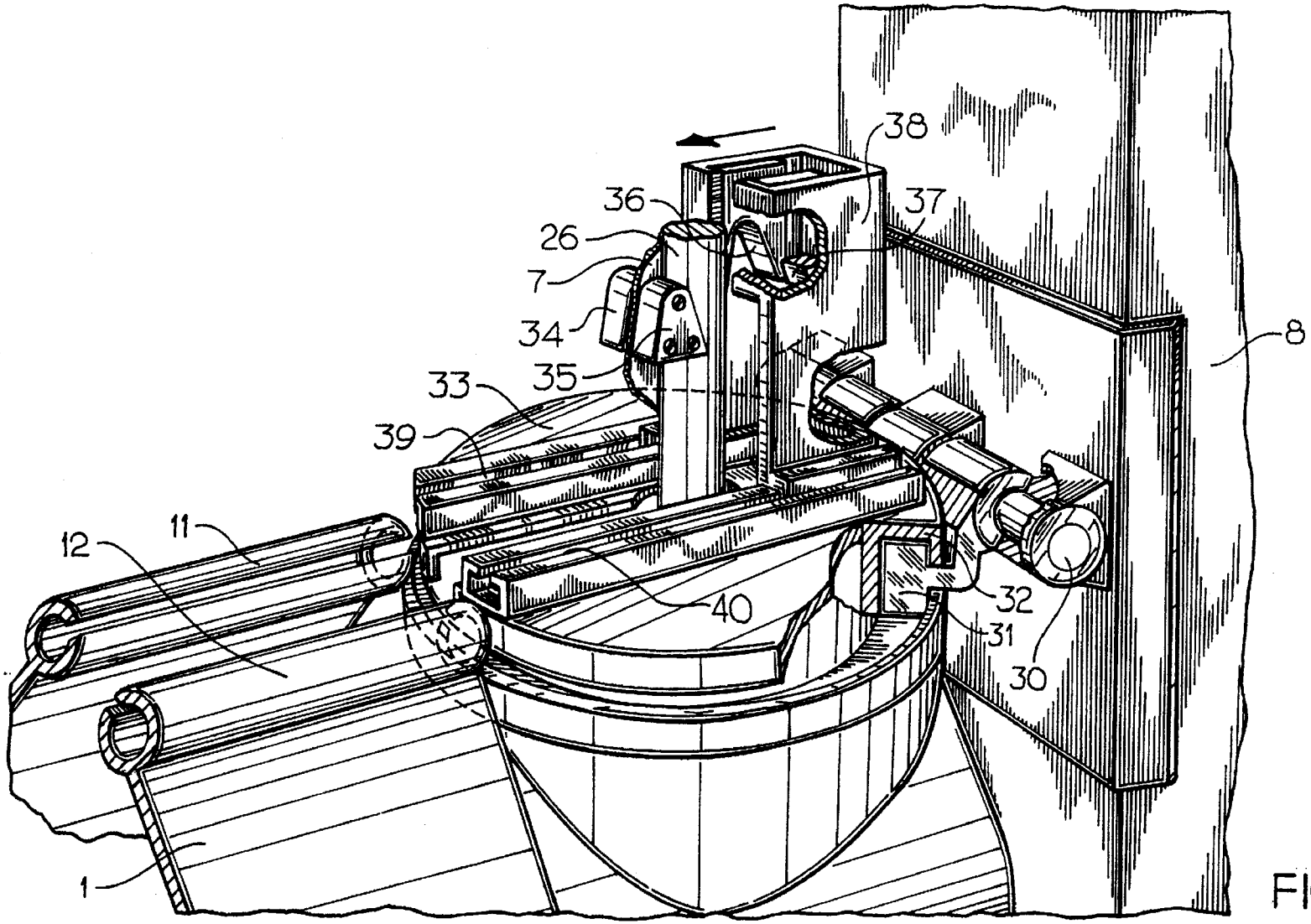
FIG. 5 shows a partly broken away respective view of a swivel device of another type than shown in FIGS. 1 and 4.

FIG. 5 shows the manner in which the boom 1 is coupled to the mast 8. The latter supports via a hinge 30 a guide rail 31 curved in a circular arc with which co-acts a correspondingly formed slide channel 32 with the undercut form shown in FIG. 5. The slide channel 32 is thus rotatable, wherein the luff 26 extends in the middle zone of the rotation. The channel 32 forms part of a support disc 33 to which the boom 1 is connected.

As previously stated, the front edge of the sail 7, that is, the zone adjoining the luff 26, also comprises blocks 34, 35 which are arranged at mutual distances and correspond with the blocks 23, 24 and which can co-act with correspohdingly formed hooks 36, 37 in a hooking body 38 which is coupled to the support disc 33 for tensile strength and for sliding by means of undercut longitudinal recesses 39, 40.

The structure shown in FIG. 5 ensures that when the boom 1 with sail 7 rotates round an approximately vertical axis the luff 26 remains situated in substantially the same position relative to boom 1. Winding up and unwinding of the sail respectively onto and from the winding shaft 6 is hereby possible in all positions without substantial change.

Figure 6:
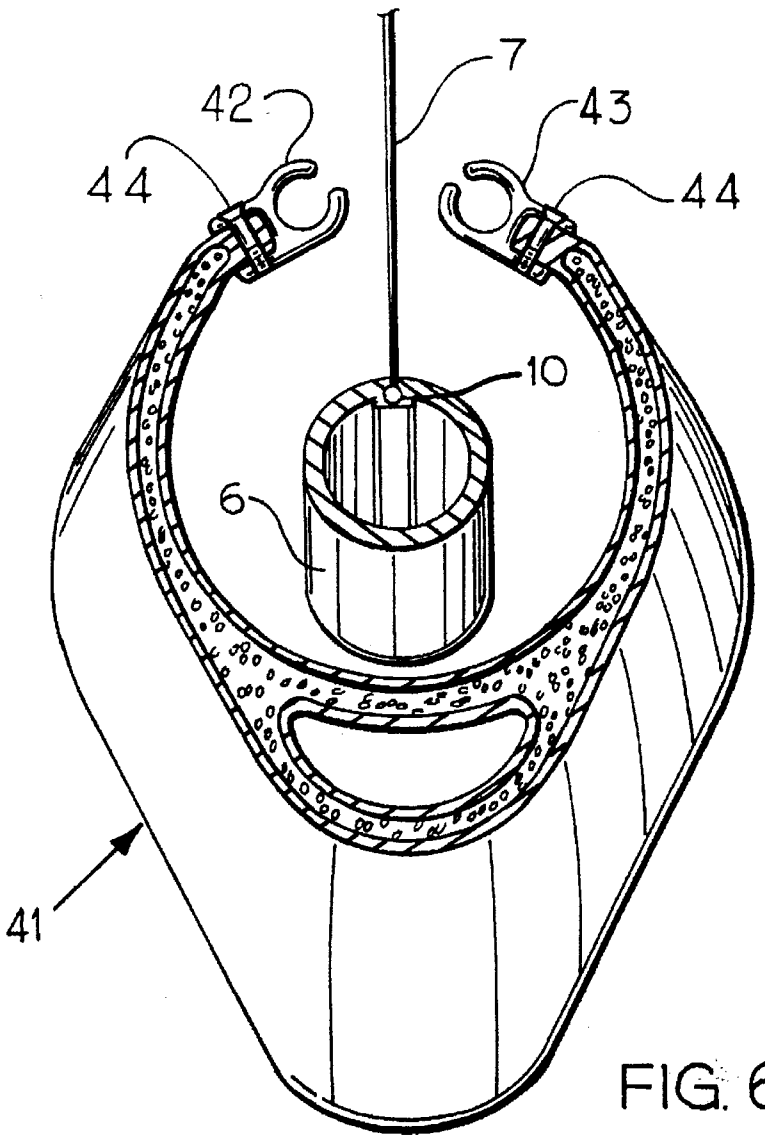
FIG. 6 shows a rear view of the boom in another embodiment with covering removed.

FIG. 6 shows a rear view of a boom 41 in another embodiment.

In contrast to boom 1 as according to FIGS. 1–4, the boom 41 is provided with coupling edges 42, 43 of aluminium, which coupling edges 42, 43 are manufactured by extrusion. The edges 42, 43 are connected to the rest of the boom 41 by glueing and making use of bolts 44.

I claim:

1. A boom for a sailing boat having a mast and a sail, with the sail having a leech with a plurality of protrusions spaced along the leech, the boom comprising:

an elongate structure which bounds a cavity extending in a longitudinal direction of the structure;

a slotted hole extending along a top side of the structure in the longitudinal direction;

first drive means;

a pulling member drivable by the first drive means and extending in the longitudinal direction for pulling through the slotted hole into the cavity and storing therein a part of the sail to be rendered inoperative, wherein the slotted hole is bounded by two substantially parallel prismatic edges;

a carriage movable along the edges, wherein the carriage co-acts with the edges such that the carriage prevents displacement of the edges away from each other and wherein the carriage is configured to reversibly engage the protrusions spaced along the leech; and second drive means, wherein the carriage is movable at least partly by the second drive means.

2. The boom as claimed in claim 1, wherein the carriage is slidable.

3. The boom as claimed in claim 1, wherein the carriage is rollable.

4. The boom as claimed in claim 1, wherein the first drive means includes at least one element which extends in a lengthwise direction, is rotatably drivable round its longitudinal axis and which is coupled to the sail for exerting on the sail during operation of the first drive means a tensile force for displacing the sail through the slotted hole into the cavity.

5. The boom as claimed in claim 4, wherein the element is a winding shaft extending in the longitudinal direction in the cavity.

6. The boom as claimed in claim 1, wherein in any operating position of the sail, the carriage assumes a position which in a reefed situation is located closer to the mast than in a non-reefed situation.

7. The boom as claimed in claim 1, wherein the second drive means includes at least one cable connected to the carriage and on which a tensile force can be exerted by a motor.

8. The boom as claimed in claim 1, wherein the carriage is fixed relative to the boom by a blocking means.

9. The boom as claimed in claim 8, wherein the first drive means is a self-braking motor.

10. The boom as claimed in claim 7, wherein the first drive means is a self-braking motor.

11. The boom as claimed in claim 1, wherein at least the edges of the slotted hole are manufactured by extrusion.

12. The boom as claimed in claim 11, wherein the edges are manufactured from aluminum.

13. The boom as claimed in claim 1, wherein the carriage is metal.

14. The boom as claimed in claim 13, wherein the metal of the carriage is selected from the group consisting of stainless steel, aluminum and titanium.

15. The boom as claimed in claim 1, wherein the carriage and the sail can be coupled in an area of a leech of the sail by coupling means.

16. A boom for a sailing boat having a mast, the boom comprising:

an elongate structure which bounds a cavity extending in a longitudinal direction of the structure;

a slotted hole extending along a top side of the structure in the longitudinal direction;

first drive means;

a pulling member drivable by the first drive means and extending in the longitudinal direction for pulling through the slotted hole into the cavity and storing therein a part of a sail to be rendered inoperative, wherein the slotted hole is bounded by two substantially parallel prismatic edges;

a carriage moveable along the edges, wherein the carriage co-acts with the edges such that the carriage prevents displacement of the edges away from each other;

second drive means, wherein the carriage is moveable at least partly by the second drive means; and hooking means, wherein the carriage and the sail can be coupled in an area of a leech of the sail by the hooking means.

* * * * *